US006560817B2

(12) United States Patent
Deiterman et al.

(10) Patent No.: US 6,560,817 B2
(45) Date of Patent: May 13, 2003

(54) FLOOR CLEANING SYSTEM

(76) Inventors: Lenard Deiterman, 14682005 Bluebird Dr., Springdale, AR (US) 72764; Alfred Lemke, 14682 Oak Crest Dr., Siloam Springs, AR (US) 72761; Carl Lemke, 2649 Kantz Dr. #5, Fayetteville, AR (US) 72703

( * ) Notice: Subject to any disclaimer, the term of this patent is extended or adjusted under 35 U.S.C. 154(b) by 0 days.

(21) Appl. No.: 09/948,213

(22) Filed: Sep. 7, 2001

(65) Prior Publication Data

US 2002/0083549 A1 Jul. 4, 2002

Related U.S. Application Data

(60) Provisional application No. 60/230,731, filed on Sep. 7, 2000.

(51) Int. Cl.[7] ..... A47L 11/34
(52) U.S. Cl. ..... 15/320; 15/339
(58) Field of Search ..... 15/320, 321, 339

(56) References Cited

U.S. PATENT DOCUMENTS 3,277,511 A 10/1966 Little et al. ..... 15/320
3,663,984 A * 5/1972 Anthony et al. ..... 15/321
4,087,881 A * 5/1978 Bates ..... 15/321
4,109,340 A 8/1978 Bates ..... 15/321
4,168,563 A * 9/1979 O'Bryan ..... 15/321
4,284,127 A 8/1981 Collier et al. ..... 165/35
4,443,909 A 4/1984 Cameron ..... 15/320
4,593,753 A 6/1986 McConnell ..... 165/51
4,803,753 A 2/1989 Palmer ..... 45/320
4,940,082 A 7/1990 Roden ..... 15/321
5,371,978 A * 12/1994 Higashikawa ..... 451/155
5,587,021 A * 12/1996 Hoersch et al. ..... 134/1
5,813,086 A * 9/1998 Ueno et al. ..... 15/320
5,871,152 A * 2/1999 Saney ..... 15/321
6,052,861 A * 4/2000 Keller ..... 15/321

* cited by examiner

*Primary Examiner*—Chris K. Moore
(74) *Attorney, Agent, or Firm*—Keisling & Pieper PLC; Trent C. Keisling; David B. Pieper

(57) ABSTRACT

An apparatus for cleaning floors which recycles waste heat and water to provide greater efficiency. An internal combustion engine is used to power the apparatus. Heat from the engine's lubricant is used to heat the wash solution applied to the floor. Heat from the engine's cooling air, radiator, and catalytic converter is used to dry the cleaned floor. A drying brush is also used to accelerate drying. Used rinse water is recycled for use as wash solution. Exhaust from the engine is used to preheat the floor to be cleaned. The engine may be used to propel the apparatus.

20 Claims, 7 Drawing Sheets

FLOOR CLEANING SYSTEM

CROSS-REFERENCE TO RELATED APPLICATIONS

This application claims priority to and is a continuation-in-part of U.S. provisional application Serial No. 60/230,731, filed Sep. 7, 2000.

BACKGROUND OF THE INVENTION

1. Field of the Invention

The present invention relates to a mobile floor cleaning machine. In particular, it relates to a floor cleaning machine using several recycling systems to maximize both energy usage and cycle time cleaning efficiency. The recycling systems include rinse water recycling, waste heat recycling and the like. Known art of relevance can be found in U.S. Classes 15 and 45 and the subclasses thereunder.

2. Known Art

As will be appreciated by those skilled in the art, there are a variety of floor cleaning machines or vacuum cleaners commercially available today. Many types of engines are available for such cleaners but most (especially household) cleaners are powered electrically. Industrial commercial cleaners however typically require more power than other cleaners so they are often powered by internal combustion engines or the like.

For Example, U.S. Pat. No. 4,803,753 to Palmer shows a self-propelled carpet scrubbing machine that is adapted to dispense cleaning solution and then recover dirty solution. The machine uses a vacuum recovery assembly and a scrub brush adapted to work the cleaning solution into the surface to be cleaned. The device does not use waste heat from the engine to heat the cleaning solution, nor does it dry the floor after cleaning, nor does it recycle its recovered rinse water or other recyclable resources.

Industrial cleaners are larger and more complex than conventional household vacuum cleaners. Many commercial cleaners employ shampoo or other cleaning agents as well. Some known devices use waste heat from the engine to heat a cleaning solution before applying it to the carpet to enhance its cleaning ability.

For example, U.S. Pat. No. 4,940,082 to Roden shows a cleaning system that uses a liquid heating system utilizing heat from the internal combustion engine. This device is not very efficient in that it does not show a method for drying carpet nor for recycling rinse water.

U.S. Pat. No. 4,593,753 to McConnell shows an exhaust gas liquid heating system for internal combustion engines. This patent is of marginal relevance in that it shows a method of heating liquids using waste exhaust heat from internal combustion engines. It also is not very efficient at capturing recyclable resources.

U.S. Pat. No. 4,443,909 to Cameron shows a carpet cleaning system that is truck mounted. The truck contains reservoirs that store a supply of cleaning fluid that is heated with the cooling water from the truck engine. The device includes a remote vacuum wand that dispenses the heated cleaning solution and then suctions it from the carpet. The device does not use waste heat from the engine to dry the carpet nor does it recover and subsequently use its water, nor does it use the engine exhaust, nor does it use the engine oil heat.

U.S. Pat. No. 4,109,340 to Bates shows another truck mounted carpet cleaning machine. The device uses waste heat from the truck engine to heat the cleaning fluid which is subsequently injected on the carpet for cleaning purposes. The dirty cleaning fluid is subsequently suctioned from the carpet via vacuum. The device has no provision for recycling the dirty solution nor drying the floor, nor capturing engine oil heat, nor preheating carpet with engine exhaust or vacuum pump air.

U.S. Pat. No. 4,284,127 to Collier et al shows another carpet cleaning system. Once again, the heat from an internal combustion engine is used to heat a cleaning solution. This device does not utilize the dirty cleaning solution as a recycle stream nor does it provide for drying of the carpet.

U.S. Pat. No. 3,277,511 to J. M. Little et al shows an adjustable width floor cleaning machine. The device does not recycle and it is inefficient.

Although these devices attempt to improve the efficiency of a carpet cleaning system, their engines still wastes a significant amount of heat. In addition, most of the systems disclosed in the known art are suitable only for large, bulky cleaning machines that must be installed in the back of a van or truck. Such systems require a wand attached to long, cumbersome hose in order to reach indoor carpeting. These systems generally do not provide a suitable means of either preheating or drying the carpet being cleaned.

Importantly, the known art fails to efficiently utilize and/or recycle all energy expended by the cleaner. Most will appreciate that operating expenses, particularly fuel costs, can be decreased if more efficient recycling methods are utilized in carpet cleaning machines. Such methods include transferring heat to a cleaning solution from the engine cooling air, exhaust, liquid coolant, and the engine block itself. Particularly useful is the transfer of waste heat from the engine lubricant to the cleaning solution.

Most floor cleaning systems in the known art recover the cleaning solution only to discarded it after use. It is therefore desirable to provide a means for using less water to clean a floor by recycling a large portion of water.

It is also desirable to have a carpet cleaning system with improved efficiency, wasting less heat energy from an internal combustion engine. It is also desirable for these qualities to be incorporated into a system small enough to be pushed around or driven by a single person.

BRIEF SUMMARY OF THE INVENTION

The present invention overcomes the above referenced problems perceived with the known art. The present invention provides a highly efficient vacuum cleaner with recycling pathways that maximize the work from the energy consumed by the vacuum cleaner in several ways. Thus, the compact and mobile vacuum cleaner of the present invention achieves higher efficiencies than those of the known art.

The present invention includes a mobile vacuum cleaner that is adapted to clean either carpeted or uncarpeted flooring. The cleaner uses multiple recycling pathways or streams that enhance the efficiency of the vacuum cleaner. The floor cleaning apparatus is mounted on a frame supported by wheels or rollers or the like that facilitate machine mobility. The frame supports a vacuum pump and reservoirs or tanks holding clean cold water, dirty water and hot cleaning solution separately. The frame also supports an internal combustion engine that provides power for the machine.

The engine of the apparatus powers the vacuum pump. In addition, the engine may also be used to power a fan to direct heated air to dry the cleaned and rinsed floor. It may also be used to propel the apparatus thereby making it easier to operate.

In one exemplary embodiment, the machine includes several distinct sections that successively clean a segment of flooring as the machine traverses the flooring. The first machine section pretreats the flooring segment. The second machine section washes the flooring segment and then suctions the segment. The third machine section rinses the flooring segment and then suctions the segment. The final machine section dries the flooring segment.

The first section utilizes a heated air stream to pretreat the flooring segment in advance of subsequent washing treatments by the machine. The pretreating section ideally heats the flooring segment from 10–100° F. to enhance subsequent cleaning treatments. The additional heat transferred to the flooring segment heats the filaments of the carpet or surface of the hard floor to further enhance the cleaning ability of the machine.

The second washing section provides a preliminary liquid treatment upon the flooring segment that is immediately followed by vacuum suctioning. The vacuum suctioning removes dirty cleaning solution and entrained contaminants from the floor segment.

The third rinsing section immediately follows the washing section. The rinsing section dispenses clean water upon the floor segment to lift any remaining residual contaminants along with soap or cleaning solution residues. The dirty or "grey" rinse water and lifted dirt and other residues are removed with vacuum suctioning. Ideally, the vacuum suctioning immediately follows liquid dispensing so that when used on carpeting the liquids do not deeply penetrate the carpet backing.

The final drying section forcefully blows drying air upon the flooring segment to complete the cleaning process. Ideally, the drying section follows the rinse section closely to assist in preventing liquid penetration of carpet backing. The drying section may be surrounded by baffles in order to create a heat plenum to more thoroughly dry the cleaned floor by penetrating depressions in a floor. This also facilitates more thorough drying around the fibers of a carpet.

The foregoing sections may include recycling streams as necessary and desirable. For example, heat from the engine, pumps and other heat generating components may be used to heat the drying air or the pretreating air or both. The "grey" water suctioned from the rinsing section may be recycled and used as a portion of the wash solution. The exhaust from the vacuum system may be used to augment the feed of heated air for the pretreating section. The use of recycling within the machine enhances the cleaning efficiency' of the machine while permitting the engine and related components to be sized smaller than those otherwise acceptable.

As an example, the rinse water may be recycled. The rinse water is applied to the washed floor and recovered by vacuum suction. After recovery, it may be filtered or otherwise treated and/or separated to remove some contaminants before it is recycled. This dirty or "grey" rinse water is recycled by first heating it by transferring heat from the engine's lubricant to a grey water recovery tank. Cleaning agents are then added to the heated rinse water so that it may be used as a cleaning solution. This cleaning solution is applied to the floor and also recovered by means of a vacuum suction tool. This used or "dirty" wash water is then collected in a reservoir or dirty water holding tank as waste water.

As another example, the cooling air can be recycled into drying air. The drying air is heated by passing it over the engine, radiator and catalytic converter. This air is combined with air that has been heated by circulation around the vacuum pump and other heat generating elements. This heated air is then directed by a recirculation fan toward the portion of the carpet that has just been cleaned and rinsed by the apparatus in order to dry the carpet.

As another example, in the pre-treating section, exhaust from the engine is recycled by directing it to the carpet prior to application of the wash and rinse solutions. The exhaust preheats the flooring, especially carpeting, to be cleaned to thereby improve the performance of the apparatus. A portion of the exhaust used to preheat the carpet can be recovered by the same vacuum suction tools used to recover the rinse water and cleaning solution. That is, the suction air can be recycled through the vacuum pump and then mixed with exhaust from the engine, and reapplied to preheat the carpet. This recycled air may be further heated as it progresses through the vacuum pump.

Thus, it is a principal object of this invention to provide a mobile apparatus for cleaning floors that uses energy more efficiently than the machines currently known in the art.

An additional object of this invention is to provide an apparatus that recycles internal combustion engine exhaust to preheat a floor.

It is a further object of this invention to provide a method for recycling air used to preheat a floor.

Another object of this invention is to provide a method for recycling heat from an engine lubricant to heat a cleaning solution.

It is a further object of this invention to provide a method for recycling the waste heat from an engine cooling air, other heat generating components of the machine and liquid coolant to dry a cleaned floor.

It is a further object of this invention to provide a method for recycling the waste heat from an engine catalytic converter to dry a cleaned floor.

Another object of the present invention is to provide an improved cleaning machine that employs multiple recycle pathways to increase the efficiency of the machine while decreasing operating expenses.

DETAILED DESCRIPTION OF THE INVENTION

The present invention overcomes the problems perceived with the known art by providing a highly efficient vacuum cleaner with multiple recycling pathways that maximize the work from the energy consumed by the vacuum cleaner in several ways. The recycling pathways enable the present invention to achieve higher efficiencies than those of the known art.

The present invention includes a mobile vacuum cleaner that is adapted to clean either carpeted or uncarpeted flooring. The floor cleaning apparatus is mounted on a frame supported by wheels. The machine is preferably powered by an internal combustion engine. The machine also has a vacuum pump and reservoirs or tanks holding clean cold water, dirty water and hot cleaning solution separately. The engine of the apparatus powers a vacuum pump. In addition, the engine may also be used to power a fan to direct heated air to dry the cleaned and rinsed floor. It may also be used to propel the apparatus thereby making it easier to operate.

Figure 1:
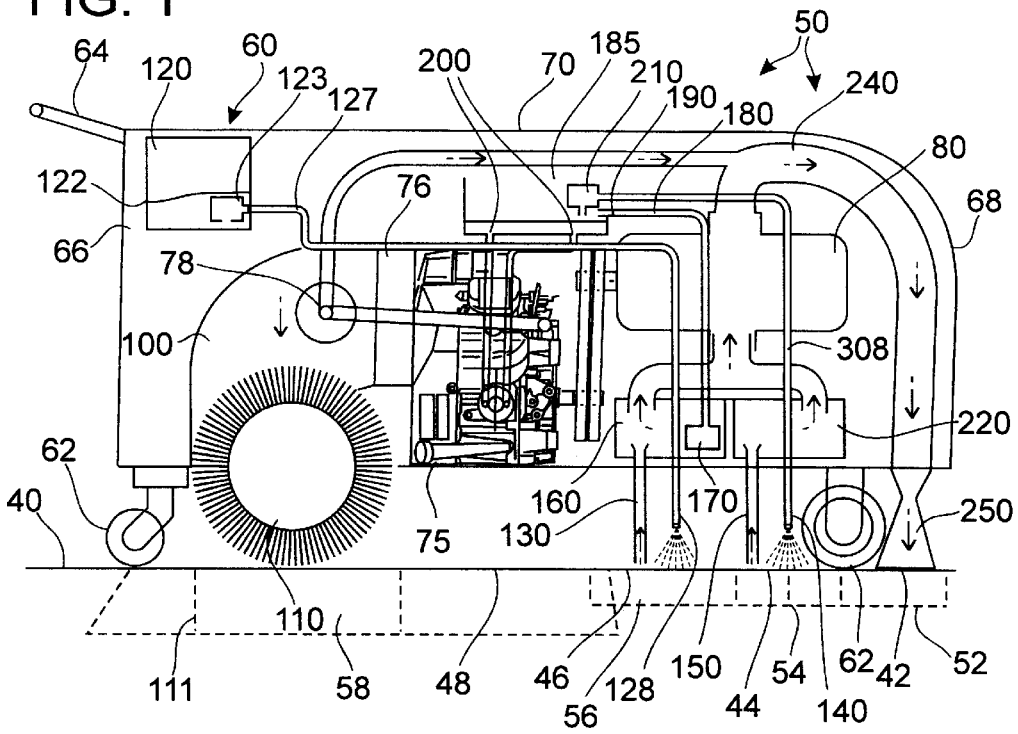
FIG. 1 is a schematic representation of an exemplary embodiment of the present invention.
Figure 2:
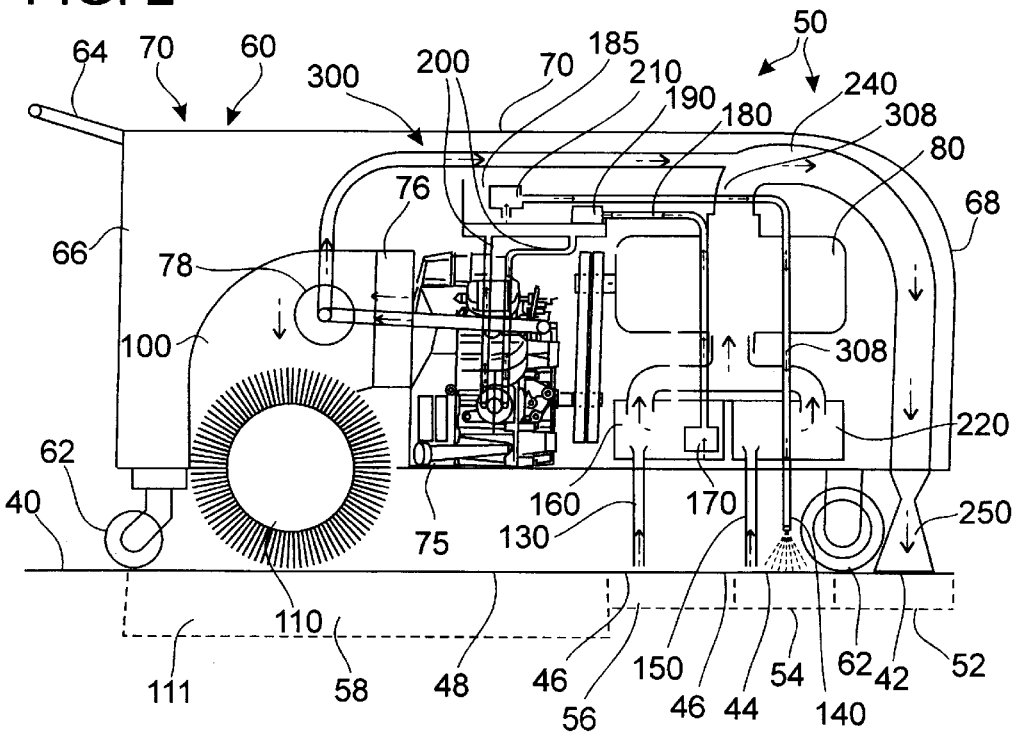
FIG. 2 is a schematic representation of another exemplary embodiment thereof showing a rinse water recycling system.
Figure 3:
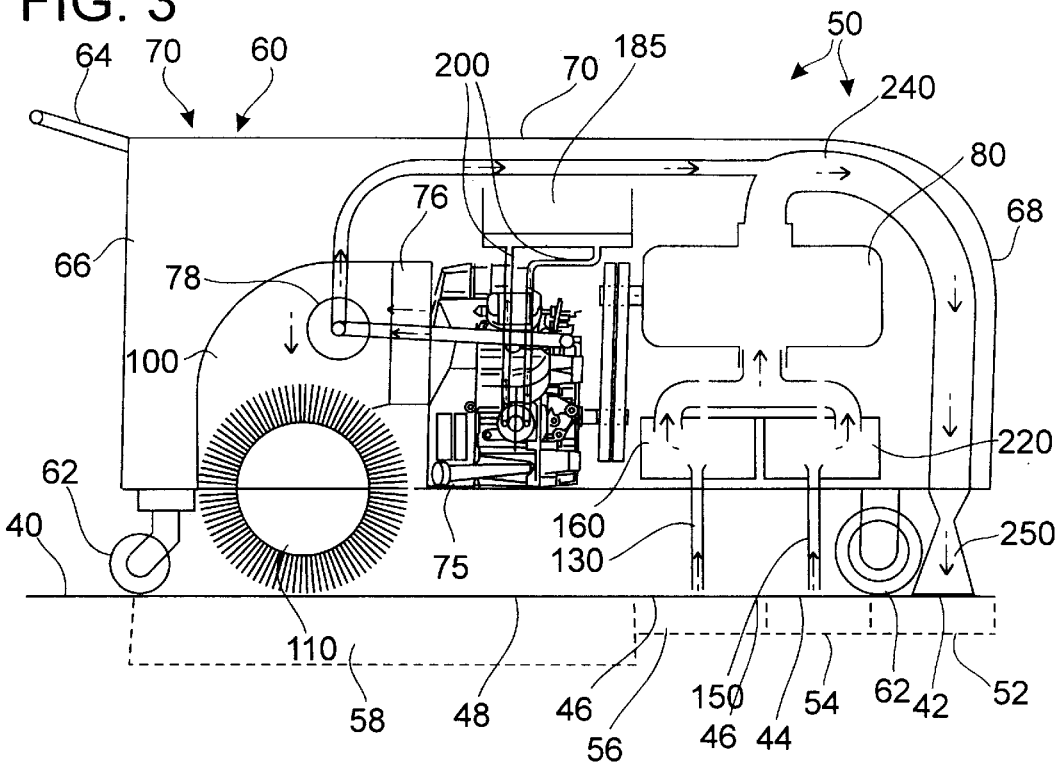
FIG. 3 is a schematic representation of another exemplary embodiment thereof showing an oil heat recycling system.
Figure 4:
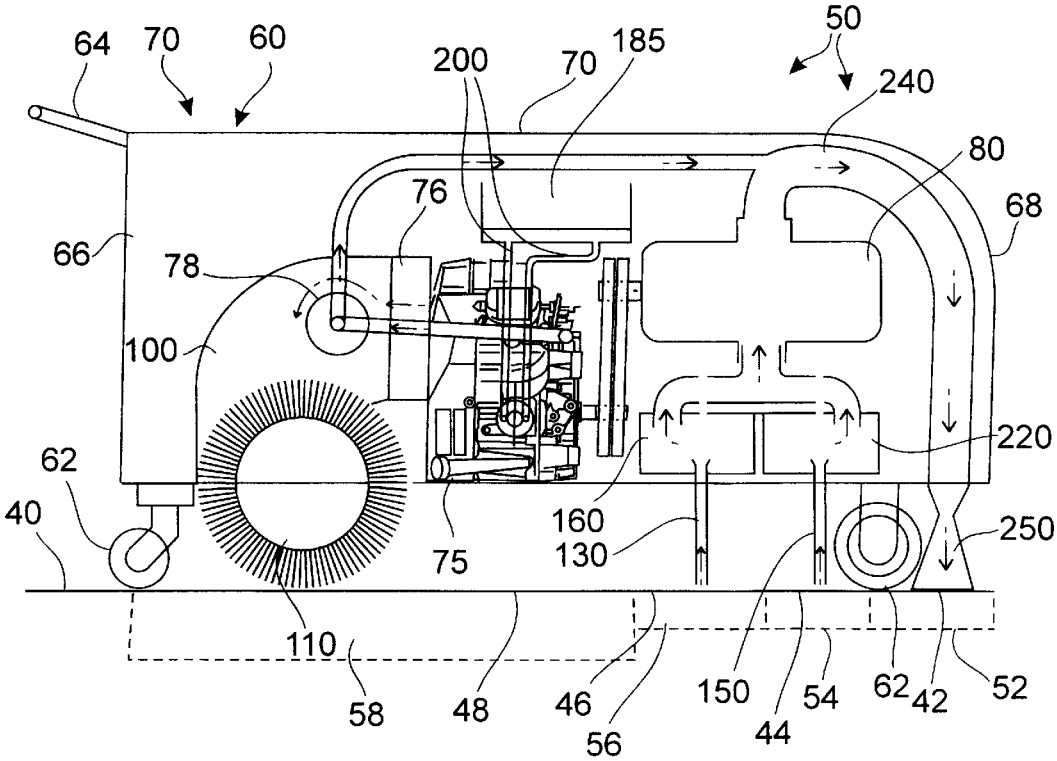
FIG. 4 is a schematic representation of another exemplary embodiment thereof showing an exhaust gasses recycling system.
Figure 5:
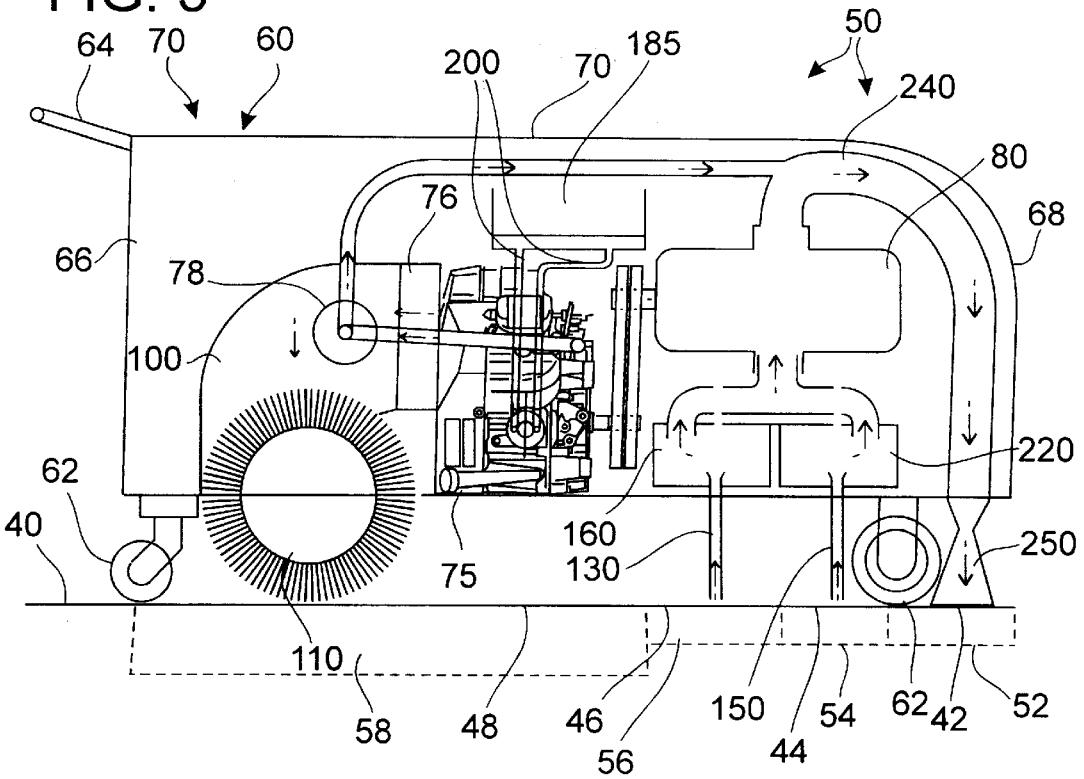
FIG. 5 is a schematic representation of another exemplary embodiment thereof showing a vacuum air recycling system.
Figure 6:
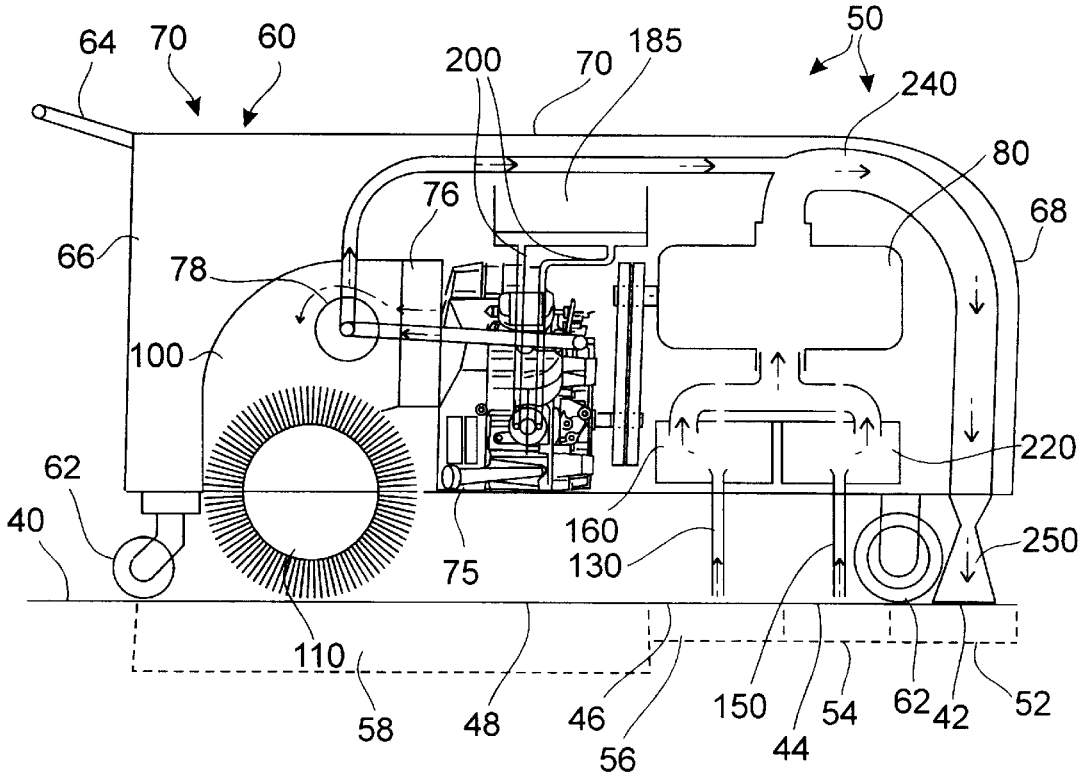
FIG. 6 is a schematic representation of another exemplary embodiment thereof showing a catalytic converter heat recycling system.
Figure 7:
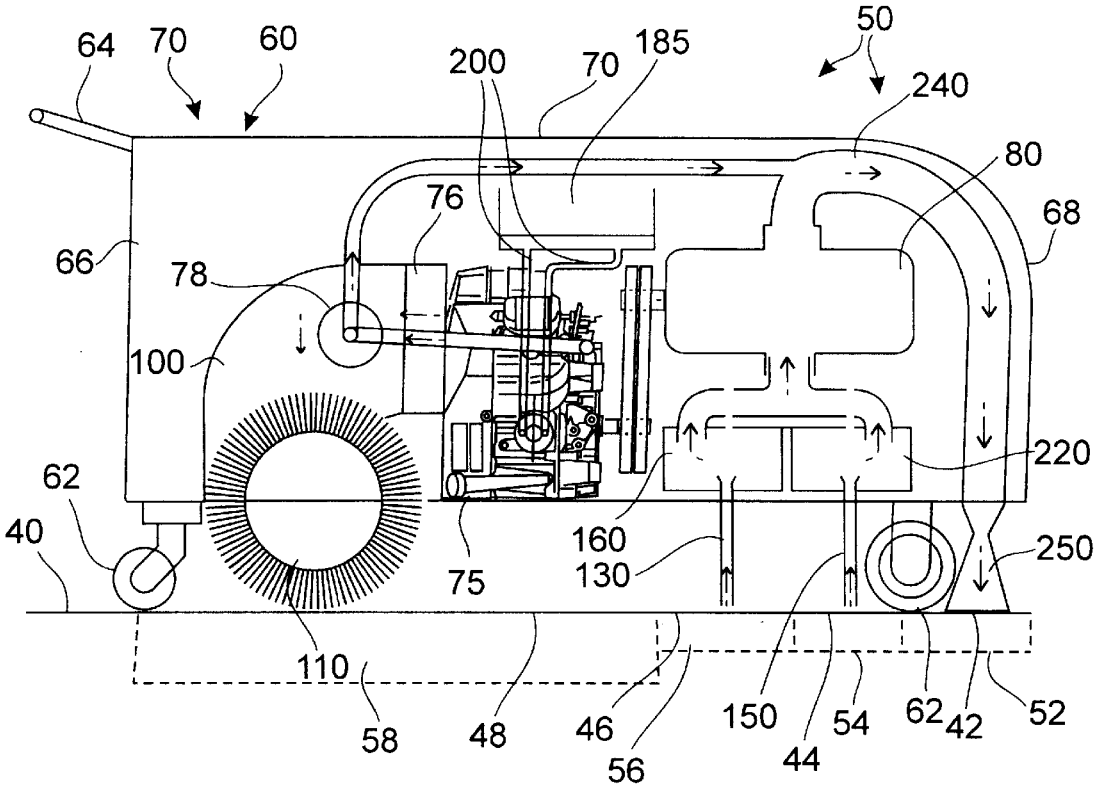
FIG. 7 is a schematic representation of another exemplary embodiment thereof showing an engine heat recycling system.
Figure 8:
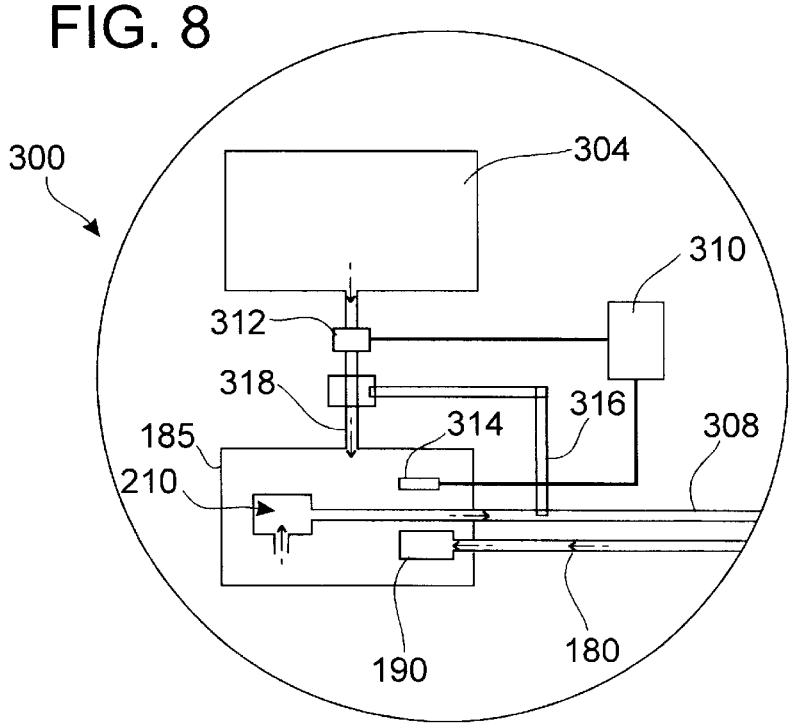
FIG. 8 is a schematic representation of an exemplary embodiment of a system to add cleaning agents to recycled rinse water.
Figure 9:
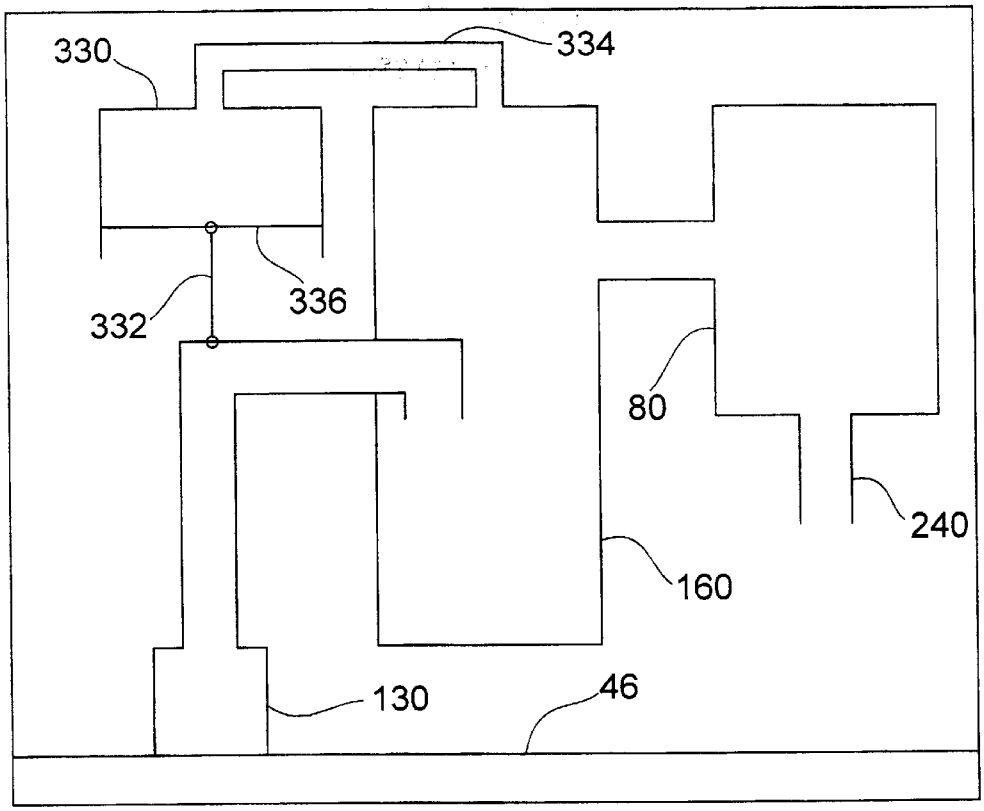
FIG. 9 is a schematic representation of an exemplary embodiment of a system to automatically adjust a suction tool in response to changes in vacuum pressure.
Figure 10:
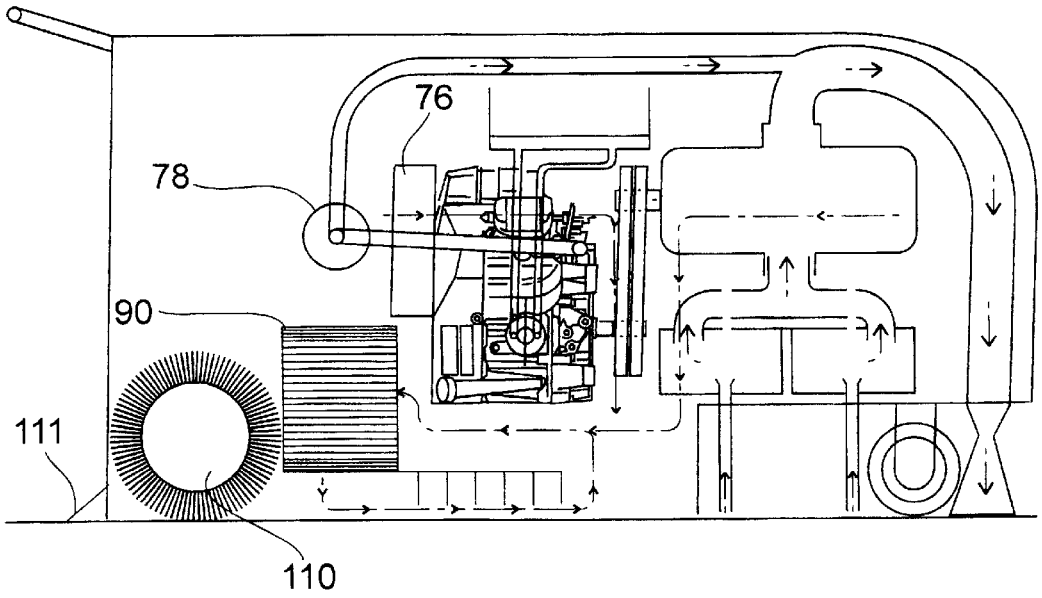
FIG. 10 is a schematic representation of an exemplary embodiment showing a waste heat recycling system.
Figures 11, 12, 13:
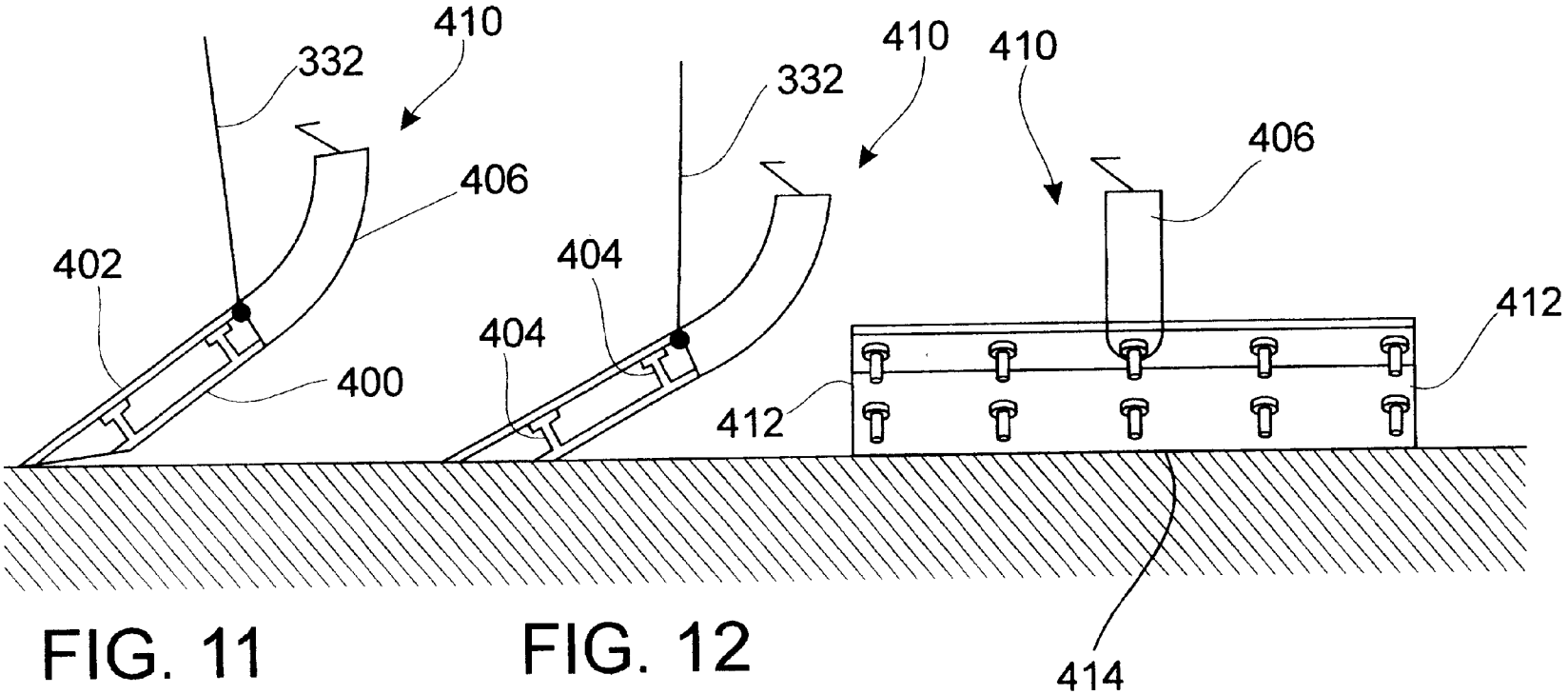
FIG. 11 is a side elevactional view of an exemplary embodiment of a vacuum suction tool in a partially raised position.
FIG. 12 is a side elevational view of an exemplary embodiment of a vacuum suction tool in a partially lowered position.
FIG. 13 is a front elevational view of an exemplary embodiment of a vacuum suction tool.
Figure 14:
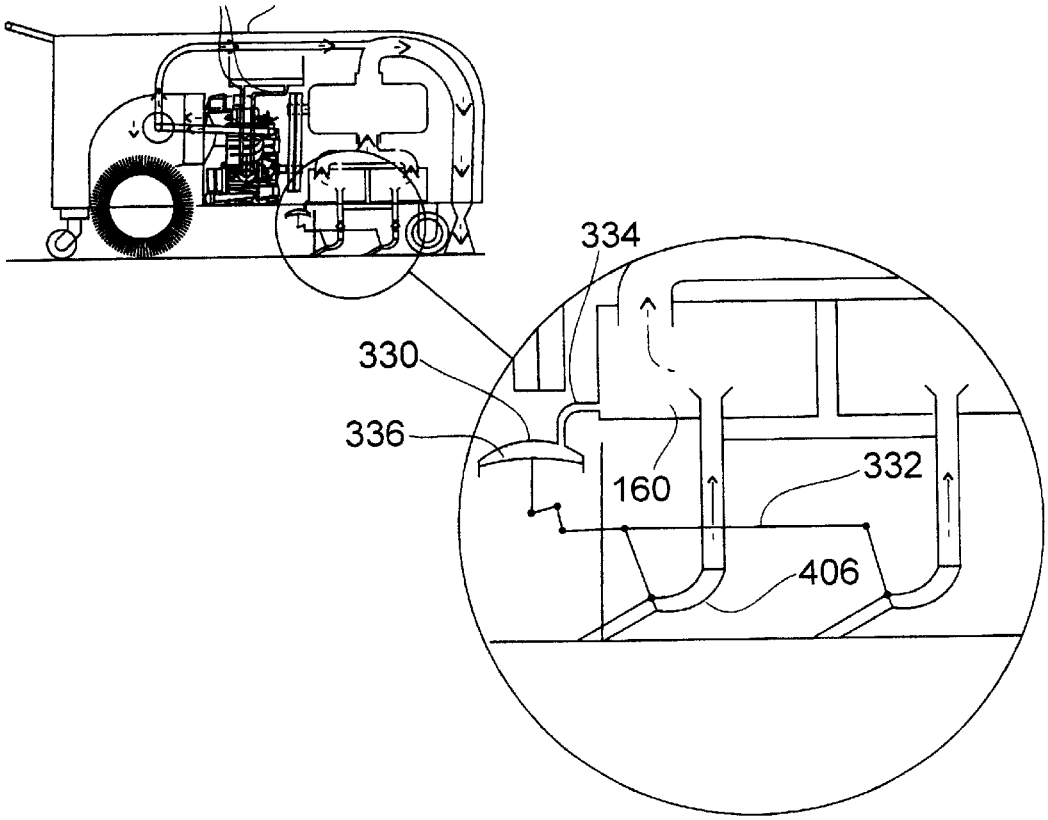
FIG. 14 is an exploded side elevational view of the vacuum system of FIG. 9.
Figure 15:
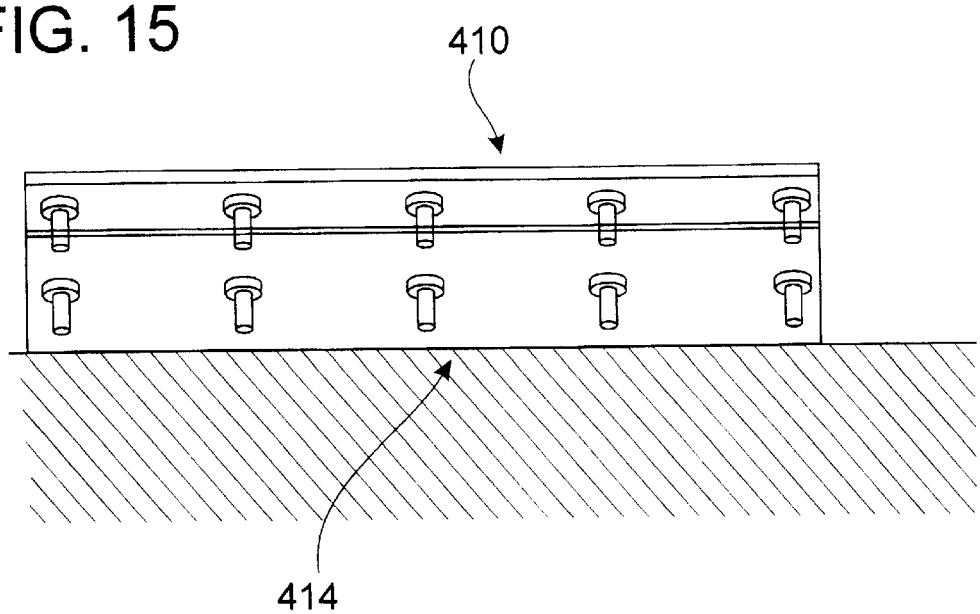
FIG. 15 is an enlarged front elevational view of the tool of FIG. 13.

The cleaning machine is generally designated by reference numeral 50 in FIGS. 1–15. The machine 50 is supported on a frame 60 supported by wheels 62. An operator's handle 64 and controls are mounted at the top of the posterior end 66 of the frame 60. A protective body 70 covers several machine components mounted on frame 60.

Supported by the frame is an internal combustion engine 75, including a radiator 76 and a catalytic converter 78. The engine powers a vacuum pump 80 and a drying fan 90. The machine 50 may be propelled either manually by the operator or by its engine 75.

In one exemplary embodiment, the machine includes four distinct sections 52, 54, 56 and 58 that clean a segment of flooring as the machine traverses the flooring 40. The first machine section 52 pretreats the flooring segment 42. The second machine section 54 washes the flooring segment 44 and then suctions the segment 44. The third machine section 56 rinses the flooring segment 46 and then suctions the segment 46. The final machine section 58 dries the flooring segment 48.

The first section 52 utilizes a heated air stream to pretreat the flooring segment 42 in advance of subsequent washing treatments by the machine 50. The pretreating section 52 ideally heats the flooring segment 42 from 10–100° F. to enhance subsequent cleaning treatments in sections 54 and 56. The additional heat transferred to the flooring segment 42 loosens entrapped dirt and the like to further enhance the cleaning ability of the machine 50.

The second washing section 54 provides a preliminary liquid treatment upon the flooring segment 44 that is immediately followed by suctioning to remove dirty cleaning solution from the floor segment 44.

The third rinsing section 56 immediately follows the washing section 54. The rinsing section 56 dispenses clean water upon the floor segment 46 to lift any remaining residual dirt along with soap residues. The water containing the remaining lifted dirt and soap residues are removed from floor segment 46 with suction immediately following dispensing of rinse water. This used rinse water may then be recycled for use as cleaning solution as described below.

The final drying section 58 forcefully blows drying air upon the flooring segment 48 to complete the cleaning process.

The foregoing sections may include recycling streams as necessary and desirable. For example, heat from the engine 75 and other heat generating components such as the vacuum pump 80 may be used to heat the drying air or the pretreating air or both. The "grey" water suctioned from the floor segment 46 may be recycled and used as a portion of the wash solution and the exhaust from the vacuum system may be used to augment the feed of heated air for the pretreating section 52. The use of recycling within the machine 50 enhances the cleaning efficiency of the machine 50 while permitting the engine 75 and related components to be sized smaller than those otherwise acceptable.

A heat plenum 100 opens at the base of the frame 50. Cooling air is drawn exteriorly from machine 50 and routed over the catalytic converter 78. The air is further heated by passage through the radiator 76 and around the engine 75. This air is combined with air that is heated by circulation over the vacuum pump 80 and other heat generating components of the machine. This combined air is then directed by recirculating fan 90 into the heat plenum 100. The recirculating fan 90 operates at a flow rate of approximately 2,000 cubic feet per minute. This fan 90, powered by the engine 75, blows this heated air onto the rinsed floor 48 and over a cylindrical, rotating drying brush 110. In addition, the air flow caused by fan 90 recirculates air over the catalytic converter, radiator, engine and other heat generating components of the machine. This causes continuous heating of the drying air by waste heat produced throughout the machine. Baffles 111 are placed laterally across the bottom of the heat plenum 100. This forces rapid flow and recirculation of the drying air in order to better penetrate depressions in a floor and around the fibers of a carpet. The engine 75 may also be used to power the rotating drying brush 110.

The oil heat recycling system consists of the port adapter, oil hoses, oil to water heat exchanger, and the thermostatic controls.

The hot oil from the engine lubrication system is re-routed through a heat exchanger to heat the washing solution. The heat exchanger is mounted in the wash water solution tank. Oil will be regulated to the heat exchanger to control the water temperature.

Hoses and/or pipes and/or tubing carry the oil from the engine to and from the heat exchanger.

The exhaust heat recycle system includes the Engine exhaust pipes, catalytic converter/heat exchanger, cooling fan, final exhaust pipe, related support brackets, and the drying area plenum.

The engine exhaust system contains a large amount of heat and unburned fuel. This unburned fuel is completely burned in the catalytic converter, creating a large quantity of heat. A large portion of the heat is captured and directed into the drying plenum. The combustion gasses are directed into the exhaust air of the vacuum system where it is mixed with cooler air and vented onto the floor for the pre-heating of the floor ahead of the wash area.

The rinse system consists of the clean water tank, pressure pump, water carrying conduit to spray nozzle, and the spray nozzle.

The rinse system provides clean water for the rinse cycle. A large tank of approximately 30 gallons supplies the required rinse water. This water is pumped to a series of spray nozzles at the floor by a pressure pump. The water is supplied at approximately 100 psi at a rate of about 1 gallon per minute. The nozzles are located on the lateral axis ahead of the rinse agitating brush. The rinse water is agitated slightly to mix with the remaining cleaning solution to enhance dilution, diffusion, dissolving and removal of cleaning chemicals applied in the wash area.

The rinse water recycling components include the rinse water recycling tank, wash water heating tank, wash water pump, wash water piping, wash water spray nozzles, and the wash water heat exchanger.

The rinse water is vacuumed up, passed through a filter, and is directed into a tank to be mixed with cleaning solution. In this tank, it is reheated with a heat exchanger and other means to bring the temperature up to a good cleaning temperature. Since the rinse water is in a low concentration state, additional chemical is required to perform well.

Additional cleaning chemicals are added by a chemical concentration modulation system. The cleaning chemical concentration modulation system includes a reservoir for storing concentrated cleaning chemicals, a cleaning solution concentration controller and sensor, and a mixture control valve.

Chemical solution concentration affects the efficiency of the complete machine. The captured rinse water already has a small percentage of chemical in it. This concentration must be brought up to a level to provide for good cleaning, but not too concentrated to prevent good rinsing. The concentration is sensed with a probe submerged in the cleaning solution tank. The data generated by the sensor is processed in the controller device which in turn opens and closes the mixture control valve.

Clean rinse water is stored in a reservoir 120. Clean water 122 is sent by pump 123 through hose 127 to high pressure rinse spray nozzles 128 posterior to the wash solution spray nozzle 140 and vacuum tool 150 where it is sprayed onto the washed floor 46. Spray nozzles 128 consist of at least one high powered nozzle spraying water at a pressure of approximately 100 psi. If more than one nozzle is used, they are aligned in a row basically perpendicular to the longitudinal axis of the apparatus.

The rinse vacuum tool 130, powered by the vacuum pump 80 located adjacent the front of the frame 68, recovers most of the rinse water in addition to some of the air used to preheat the floor 46. The rinse water is drawn into a "grey" water reservoir 160. From there, another pump 170 pumps the rinse water through a hose 180 and a filter 190 to a heat exchanger 185. There the rinse water is heated by engine lubricant which is cycled through the exchanger 185 by means of two tubes 200. Sensors monitor the temperature of the recycled rinse water. The heat exchanger is regulated in order to maintain the rinse water at the desired temperature.

Sensor 314 monitors the concentration of the selected cleaning agents in the water. Concentrated cleaning agents are stored in a reservoir 304. The operator sets the cleaning agent concentration controller 310 to a desired concentration. When sensor 314 detects that the cleaning agent concentration has fallen below the desired level, concentration controller 310 opens mixture control valve 312. This allows additional cleaning agent to mix with the recycled rinse water in heat exchanger 185 by moving through tube 318. When the desired concentration is detected by sensor 314, concentration controller 310 closes valve 312. To facilitate mixing of added cleaning agent with recycled rinse water, a feedback hose 316 redirects some of the cleaning solution from tube 308 into tube 318. This creates a venturi or siphoning affect in tube 318 that enhances diffusion, dissolution and dilution of the cleaning agents added to the rinse water in heat exchanger 185.

Once the recycled rinse water is heated and combined with the cleaning agent, it is used as a cleaning solution. Pump 210 pumps the cleaning solution at a rate of about five (5) gallons per minute at a pressure of approximately 100 psi. Four of the five gallons per minute are directed into feedback hose 316. The remaining gallon per minute of cleaning solution, still at approximately 100 psi, travels through tube 308 to high pressure spray nozzles 140 posterior to the preheating vent 250 and anterior to the wash vacuum tool 150. Spray nozzles 140 consist of at least one nozzle that applies cleaning solution to preheated floor 44. If more than one is used, they are aligned in a row basically perpendicular to the longitudinal axis of the apparatus. The wash vacuum tool 150, immediately posterior to the wash nozzles 140 and powered by the vacuum pump 80, recovers most of the wash solution as well as some of the air used to preheat the floor 44. The used wash solution is deposited in a reservoir 220 as waste water. The pumps 123, 170 and 210 are powered by the engine 75.

The vacuum system air recycling includes the vacuum pickup nozzles, rinse water pickup tank, wash water pickup tank, vacuum pump, pump exhaust duct, and the air nozzles.

The engine driven vacuum pump provides a source of recycled warm air for heating the floor surface or carpet prior to cleaning solution being applied. The vacuum system picks up rinse and wash water from the floor and directs it into the appropriate tanks. The air that is moved in the operation gets warm as it passes through the pump.

The vacuum tool needs to be flexible to insure a constant vacuum pressure and air flow at all portions of the tool. The tool is made of two pieces of flat material running in parallel and in close proximity of each other. They will be approximately one half inch apart to insure rapid air movement to carry water away from the floor. The flat plates will be loosely connected to each other so they can flex independently thereby preventing rigidity of the tool. The ends of the tool will be closed to prevent air flow from the ends and lowering the pressure at the floor. The tool will be connected to a diaphragm controller that senses the vacuum pressure in the tanks and regulates the height of the tool above the floor to keep a constant pressure and thereby insureing constant air flow.

The air retrieved by the wash and rinse vacuum tools 130 and 150 is drawn out of the wash and rinse reservoirs 160 and 220 by the vacuum pump 80. This air passes through the vacuum pump 80 where it is heated by waste heat from the pump. The air is then mixed with exhaust from the engine 75 in duct 240. This further heats the air. This air travels through duct 240 to a vent 250 at the anterior end of the apparatus where it is blown onto the untreated floor 42 prior to application of the wash solution. Using hot air to preheat the floor 42 enhances the wash solution's effectiveness. A significant portion of this preheating air is recaptured by the wash and rinse vacuum tools 130 and 150, and the cycle is repeated.

Vacuum suction tools must be in substantial contact with the floor in order to efficiently retrieve wash and rinse waters as well as loosened dirt. There is known in the art methods of adjusting the height of vacuum tools manually. Those skilled in the art will appreciate a means for making vacuum tools automatically self adjusting. This allows for more accurate placement of the vacuum tools on the floor and results in more efficient recovery of wash and rinse waters. This also allows cleaning of textured or uneven floors and enhances the overall cleaning ability of the machine.

One or both of rinse vacuum tool 130 and wash vacuum tool 150 may be automatically self adjusting. A vacuum tool is attached to a vacuum diaphragm 336 in a vacuum chamber 330. Vacuum chamber 330 is vertically positioned so that the force of gravity on the vacuum diaphragm 336 counters the vacuum pressure in chamber 330. Vacuum chamber 330 is connected to either rinse water reservoir 160 or wash water reservoir 220 by a tube 334. The vacuum diaphragm is connected to either rinse vacuum tool 130 or wash vacuum tool 150 or both by a linkage 332. When the suction pressure in the reservoir increases, the vacuum diaphragm 336 raises within the vacuum chamber 330. This lifts the vacuum tool or tools via linkage 332. When suction pressure in the reservoir decreases, the vacuum diaphragm 336 lowers and likewise lowers the vacuum tool. This automatic adjustment of the vacuum tool facilitates application of a constant suction pressure by the vacuum tool on the floor being treated.

Those skilled in the art of cleaning floors will appreciate that many floors and carpets do not have a perfectly flat surface. Therefore, in order to ensure strong, steady suction the vacuum tool itself must be somewhat flexible. This particular embodiment of the present invention provides a flexible vacuum tool 410 as shown in FIGS. 11, 12, 13,14 and 15. Vacuum tool 410 includes a rear wall 402 and a front wall 400 that are parallel to each other. Tool 410 also includes side walls 412 that are also parallel to one another. Side walls 412 can flex so as to allow front and rear walls 400 and 402 to flex independently of one another. Walls 400,402 and 412 are composed of a flexible material such as rubber, plastic or the like.

Attached to front wall 400 are spacing rods 404 that are approximately one half inch in length. Spacing rods 404 extend in the direction of the rear wall 402 on the interior of the vacuum tool 410 for maintaining a constant volume within the tool. This prevents the tool 410 from collapsing and assures constant air flow within the tool 410. Attached to the top of tool 410 is flexible suction hose 406, composed of a flexible material such as rubber, plastic or the like. The suction provided by vacuum pump 80 via hose 406 keeps tool 410 substantially on the ground. The flexibility of walls 400 and 402 allow the suction tool 410 to maintain high vacuum pressure while traversing irregularities 414 in a floor.

Those skilled in the art will appreciate that even a minor adjustment in the vertical position of the vacuum tool can substantially reduce the suction being applied to the floor. It is desirable to adjust the vacuum tool 410 in such a way that the suction applied is still substantial enough to effectively remove dirt and solution from the floor. Attached to the top of tool 410 is linkage 332. Linkage 332 connects to the rear end of the top of tool 410. When the vacuum diaphragm 336 raises, linkage 332 pulls tool 410 up in such a manner as to lift only the bottom of front wall 400 off the ground. Rear wall 402 remains in contact with the floor. This allows only a small opening between the floor and vacuum tool. Those skilled in the art will appreciate that such a system will decrease applied suction pressure without losing substantially all suction pressure.

The catalytic converter heat recycling system include the catalytic converter, fan, air ducting, temperature control devices, and the air control nozzles.

The catalytic converter heat recycling system captures the heat generated in the device and moves the heat to the rear of the machine to be injected onto the floor to provide for the final drying operation. The air passing over the catalytic converter is supplied by a high capacity fan that recycles the air in the plenum above the floor.

The components of the engine heat recycling and hot air recycling are the engine radiator, fan shroud, engine powered fan, thermostat, air ducting, air recirculating fan, and the air nozzles.

The liquid cooling system of the internal combustion engine provides a large quantity of recyclable heat. Heat can also be recovered from other heat generating components of the machine such as the vacuum pump and other pumps. This heat is directed into a drying plenum to lower the relative humidity in the plenum. The heat from the radiator is directed into the drying plenum by means of an engine driven fan. In addition to the engine driven fan, a high capacity recirculating fan is installed to direct the hot air in the plenum onto the floor to rapidly dry the floor surface or the carpet, whichever the case may be. The recirculation fan operates at a flow rate of approximately 2,000 cubic feet per minute. The sides of the plenum will be nearly sealed to prevent too much air from escaping frm the plenum. The volume of escaping air can be controlled by a device to regulate the temperature in the plenum if necessary. The temperature of the engine coolant is controlled by a thermostat in the cooling liquid.

Whereas, the present invention has been described in relation to the drawings attached hereto, it should be understood that other and further modifications, apart from those shown or suggested herein, may be made within the spirit and scope of this invention.

What is claimed is:

1. A recycling floor treatment apparatus comprising:

a mobile frame;

an internal combustion engine mounted on said frame and adapted to provide motive power;

a vacuum pump powered by said engine and operatively associated with means adapted to treat a floor, said means including means for applying a liquid cleaning solution to the floor and means for subsequently recovering said liquid from the floor, said floor treatment means also adapted to heat the floor to enhance the penetration of said liquid; and, wherein said liquid is recovered and recycled by said vacuum pump and said means for recovering.

2. The apparatus as described in claim 1 wherein said apparatus recycles heat removed from the group including engine exhaust, liquid engine coolant, air engine coolant, engine lubricant, catalytic converter, engine and vacuum pump.

3. The apparatus as described in claim 2 wherein said cleaning solution includes soap and said soap is removed during liquid recovery.

4. The apparatus as described in claim 3 wherein heat from the exhaust of said engine is recycled to heat the floor.

5. The apparatus as described in claim 3 wherein heat from the liquid coolant of said engine is recycled to heat the floor.

6. The apparatus as described in claim 3 wherein heat from air that cools said engine is recycled to heat the floor.

7. The apparatus as described in claim 3 wherein heat from the lubricant of said engine is recycled to heat said cleaning solution.

8. The apparatus as described in claim 7 further including means for regulating the heat recycled from said engine lubricant.

9. The apparatus as described in claim 3 wherein heat from the catalytic converter of said engine is recycled to heat the floor.

10. A recycling floor treatment apparatus comprising:

a mobile frame;

an internal combustion engine mounted on said frame and adapted to provide motive power;

a vacuum pump powered by said engine and operatively associated with means adapted to treat a floor, said means including means for applying a liquid cleaning solution to the floor and means for subsequently recovering said liquid from the floor, said floor treatment means also adapted to heat the floor to enhance the penetration of said liquid; and, wherein said liquid is recovered and recycled by said vacuum pump and said means for recovering and wherein heat from said engine is recycled to heat a floor.

11. The apparatus as described in claim 10 wherein heat from said vacuum pump is recycled to preheat a floor.

12. The apparatus as described in claim 10 wherein a rinse liquid is recycled to be used as a cleaning solution.

13. The apparatus as described in claim 12 further including means for regulating the concentration of cleaning agents in said recycled liquid.

14. The apparatus as described in claim 12 wherein said engine is used to power a second vacuum pump used to recycle air used to preheat said floor.

15. The apparatus as described in claim 12 wherein said engine is used to power a fan that circulates air used to dry the floor.

16. The apparatus as described in claim 12 wherein said engine is used to power a brush or brushes used to dry the floor.

17. A recycling floor treatment apparatus comprising:

a mobile frame;

an internal combustion engine mounted on said frame and adapted to provide power;

a vacuum pump powered by said engine and operatively associated with means adapted to treat a floor, said means including means for applying a liquid cleaning solution to the floor and means for subsequently recovering said liquid from the floor, said floor treatment means also adapted to heat the floor to enhance the penetration of said liquid; and, wherein said liquid is recovered and recycled by said vacuum pump and said means for recovering and wherein said internal combustion engine is used to propel said mobile vehicle.

18. The apparatus as described in claim 17 wherein heat from said vacuum pump is recycled to preheat a floor.

19. The apparatus as described in claim 17 wherein a rinse liquid is recycled to be used as a cleaning solution.

20. The apparatus as described in claim 17 wherein said engine is used to power a fan that circulates air used to dry the floor.

* * * * *

UNITED STATES PATENT AND TRADEMARK OFFICE

CERTIFICATE OF CORRECTION

PATENT NO. : 6,560,817 B2
DATED : May 13, 2003
INVENTOR(S) : Alfred Lemke and Carl Lemke It is certified that error appears in the above-identified patent and that said Letters Patent is hereby corrected as shown below:

Title page,
Item [76], Inventors, "Lenard Deiterman, 14682005 Bluebird Dr., Springdale, AR (US) 72764; Alfred Lemke, 14682 Oak Crest Dr., Siloam Springs, AR (US) 72761; Carl Lemke, 2649 Kantz Dr. #5, Fayetteville, AR (US) 72703" should read -- Alfred Lemke, 14682 Oak Crest Dr., Siloam Springs, AR (US) 72761; Carl Lemke, 2649 Kantz Dr. #5, Fayetteville, AR (US) 72703 --.

Signed and Sealed this

Twenty-ninth Day of June, 2004

JON W. DUDAS
*Acting Director of the United States Patent and Trademark Office*